United States Patent [19]

Fellrath et al.

[11] 4,228,534

[45] Oct. 14, 1980

[54] ELECTRONIC WATCH CONTROL DEVICE FOR MANUAL ACTUATION

[75] Inventors: Jean Fellrath, Neuchâtel; Jean-Felix Perotto, Hauterive, both of Switzerland

[73] Assignee: Centre Electronique Horloger S.A., Neuchâtel, Switzerland

[21] Appl. No.: 847,813

[22] Filed: Nov. 2, 1977

[30] Foreign Application Priority Data

Nov. 4, 1976 [CH] Switzerland ..... 13899/76

[51] Int. Cl.[3] ..... G04B 19/00; G04C 17/00; H01H 35/00; H01H 47/00

[52] U.S. Cl. ..... 368/224; 368/239; 307/116; 307/130

[58] Field of Search ..... 58/23 R, 23 BA, 23 A, 58/50 R, 85.5; 307/112, 116 R, 125, 129, 130, 308; 301/111-113, 179, 181, 184; 340/561, 562

[56] References Cited

U.S. PATENT DOCUMENTS

| | | | |
|---|---|---|---|
| 3,497,995 | 3/1970 | Forsberg | 340/562 X |
| 3,749,984 | 7/1973 | Benton, Jr. et al. | 307/308 |
| 3,750,126 | 7/1973 | Solomon | 301/181 |
| 3,784,848 | 1/1974 | Hamilton | 307/308 |
| 3,829,850 | 8/1974 | Guetersloh | 361/181 |
| 3,927,336 | 12/1975 | Carlson et al. | 307/308 |
| 3,956,743 | 5/1976 | Geiszler et al. | 340/561 |
| 4,047,010 | 9/1977 | Perotto et al. | 235/156 |
| 4,055,755 | 10/1977 | Makamura et al. | 307/116 |

*Primary Examiner*—Vit W. Miska

*Attorney, Agent, or Firm*—Cushman, Darby & Cushman

[57] ABSTRACT

An electronic watch control device for manual actuation is disclosed. It comprises a capacitive sensor including a conductive layer on the inner surface of the watch-glass, which is actuated by placing a finger-tip on the outer side of the watch-glass. The sensor is part of a capacitive voltage divider to which a high frequency voltage is applied. Synchroneous detection means are arranged for detecting the high-frequency voltage drop across the sensor in synchronism with the high-frequency. Comparison means are provided for comparing the value of the said voltage drop to a reference voltage and producing a control signal depending on the condition of the sensor.

5 Claims, 13 Drawing Figures

ELECTRONIC WATCH CONTROL DEVICE FOR MANUAL ACTUATION

The present invention relates to electronic watches and more particularly to control devices to be actuated by hand for performing a specific function of the watch. For instance, when using the watch as a chronograph or timer operated by hand or when triggering the display of various time indications such as seconds, minutes, hours, the date and others at the moment when one observes the watch, so as to reduce the power consumption thereof and allow multiple data to be displayed, control devices of the kind herein referred to are required for manually controlling the watch. It will be understood that they are of particular interest for quartz crystal controlled watches with digital display means.

It has already been proposed (German patent application No. 2,429,193) to replace the usual manually operated control members of watches such as push-buttons, by a capacitive sensor comprising a conductive layer on the inner side of the watch-glass. The variation of capacitance occuring when the watch-glass is touched with one's finger was intended according to this proposal to change the state of a bistable multivibrator. However no details of realisation of such a device were given in the said publication.

The main object of the present invention is to provide a most reliable control device for electronic watches making use of a capacitive sensor inside the watch and allowing to control precisely one or more watch functions.

A further object of the invention is to provide a control device which is not disturbed by usually existing external influences such as the electric field of the mains current, and which maintains its precise operation in particular when the voltage of the power supply, such as a dry cell, of the watch deviates from its normal value.

The electronic watch control device for manual actuation according to the invention comprises a capacitive sensor which includes a conductive layer applied on at least a part of the inner surface of the watch-glass and the capacitance of which with respect to ground as represented by the watch-case varies when the user puts a finger on the watch-glass, the said sensor being part of a capacitive voltage divider. The control device further comprises means for applying to the said capacitive voltage divider an a.c. voltage of substantially higher frequency than the mains frequency, synchroneous detection means for detecting the high frequency voltage drop accross the said capacitive sensor and comparison means for comparing the value of the said voltage drop to a reference voltage. The said comparison means are adapted for producing a control signal depending on whether or not the sensor is actuated by placing a finger-tip on the watch-glass.

The conductive layer of the sensor which is applied on the inner surface of the watch-glass is preferably transparent. The synchroneous detection means for detecting the high frequency voltage drop across the capacitive sensor preferably comprise switching means connected to the sensor and controlled in synchronism with the said high frequency so as to alternately short-circuit the sensor and apply the voltage appearing across the same to a low-pass filter. The output of the same will then be the mean value of the high-frequency voltage drop across the capacitive sensor.

Further objects and advantages of the invention will become apparent from the following description of various embodiments of the invention as shown in the accompanying drawings in which.

Figure 1:
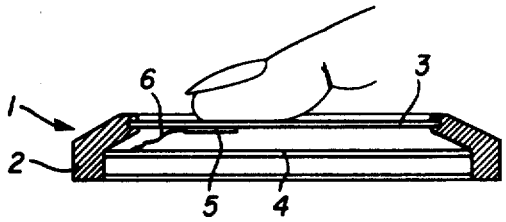
FIG. 1 is a simplified cross-sectional view of a watch comprising a capacitive sensor.

The schematic cross-sectional view of FIG. 1 shows a wrist watch 1 having a watch-case 2 and a watch-glass 3. An electronic circuit 4 is arranged inside the watch-case. A conductive layer 5 which can be transparent or not, is provided under the watch-glass and is electrically connected to circuit 4 by means of a wire 6. The conductive layer 5 has a certain capacitance with respect to the watch-case, which capacitance is determined by the geometrical arrangement of said both parts.

If the person bearing the watch places a finger-tip on the watch-glass 3 opposite to the conductive layer 5, the capacitance of the latter with respect to the watch-case changes due to the fact that the finger represents ground potential as does the watch-case and it is separated from the conductive layer 5 by the watch-glass 3 of dielectric material. It is thus possible to use the said change in capacitance for producing a control signal each time the watch-glass is contacted by one's finger and therefore to provide a capacitive sensor based on this effect.

Figure 2:
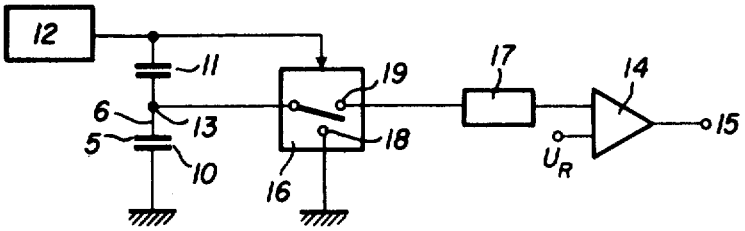
FIG. 2 is a schematic diagram of the electric circuit of a control device according to the invention.

FIG. 2 shows a device for producing a control signal in response to an actuation of a capacitive sensor of the aforesaid type. A capacitive sensor comprising the conductive layer 5 of FIG. 1 is referenced 10 in FIG. 2. Through the conductive wire 6 the sensor 10 is connected in series with an injector capacitor 11, 10 and 11 forming a capacitive voltage divider between ground and an output terminal of an a.c. voltage source 12. The potential of the connecting point 13 between the sensor 10 and the capacitor 11, or stated otherwise the potential drop of the a.c. voltage across the sensor 10 is therefore representative of the actuated or not actuated condition of the sensor. Point 13 could be connected directly to a first input of comparator 14, a reference voltage $U_R$ being applied to a second input of this comparator. The output 15 of comparator 14 could then provide a signal depending on whether or not the value of the voltage drop between point 13 and ground exceeds the reference voltage $U_R$.

However, such a very simple device would not work correctly when the person bearing the watch stays in a place where the electric field due to the mains current, having for instance a frequency 50 Hz, is of some strength. Such a field leads to a relatively high disturbing voltage across the sensor and would lead to false operation of the device. To eliminate this effect the a.c. voltage source 12 of FIG. 2 is adapted to produce a signal of a substantially higher frequency than the mains frequency and a synchroneous detection device is connected between point 13 and the first input of comparator 14. As will be explained below, the arrangement can in this case be made to detect the mean value of the high-frequency voltage drop across the capacitive sensor without being affected by the mains current field.

A synchroneous detecting device can comprise, as shown in FIG. 2, a switching device 16 controlled by the high-frequency signal of generator 12 and can be followed by low-pass filter 17. The switching device 16 alternately connects point 13 to ground potential as schematically shown at 18 in FIG. 2, and to a terminal 19 connected to filter 17. When the high-frequency voltage which preferably comprises square wave pulses is high, switch 16 is controlled to connect point 13 to terminal 19 and when the high frequency voltage is low, point 13 is connected to the ground terminal 18, short-circuiting the capacitive sensor 10. Filter 17 provides a signal representing the mean value of the a.c. voltage across sensor 10.

Figure 3A:
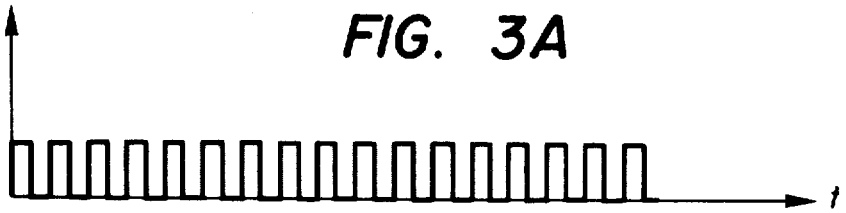
FIGS. 3A to 3D are time-charts illustrating the operation of the device of FIG. 2.
Figure 3B:
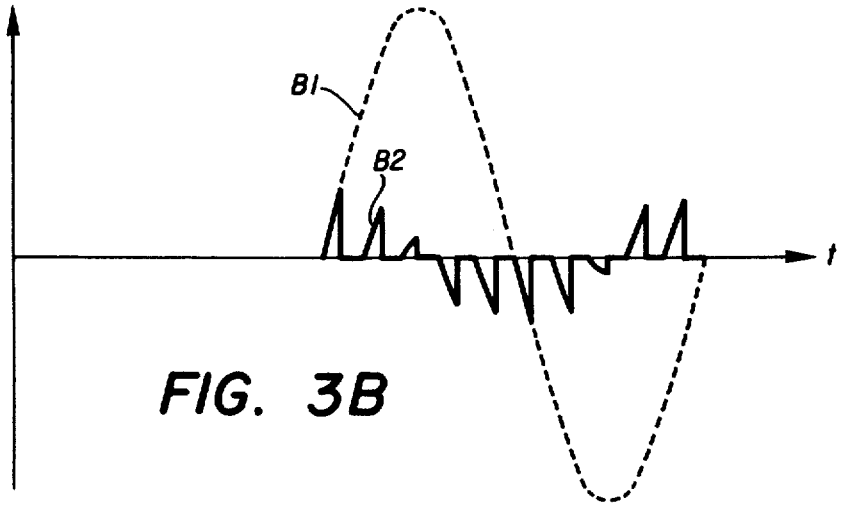

The operation of the control device of FIG. 2 will be explained in more details by means of the time-charts of FIGS. 3A to 3D. FIG. 3A shows a high-frequency signal of square wave-form delivered by generator 12. FIG. 3B shows as a dashed line B1 the voltage induced in the sensor by an electric field of the mains frequency when the person bearing the watch stays in such an electric field and puts a finger on the watch-glass. The pulses B2 shown in FIG. 3B are the portions of the voltage B1 which actually appear at the output terminal 19 of the switching device 16. It will be seen that the disturbing signal is periodically brought back to 0 in synchronism with the high-frequency pulses of FIG. 3A and that the influence thereof (time integral) decreases with increasing frequency of the high-frequency control pulses.

Figure 3C:
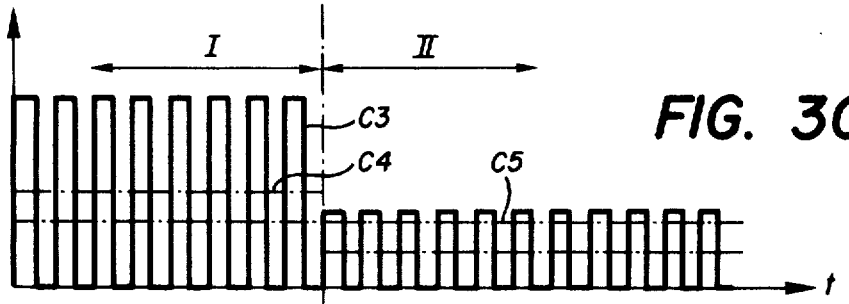
Figure 3D:
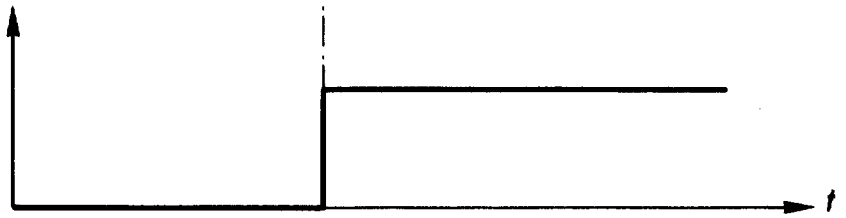

FIG. 3C and 3D comprise two parts, the left part I corresponding to the non-actuated condition of the sensor and the right part II corresponding to the actuated condition thereof, i.e. a finger being placed on the watch-glass.

The square wave C3 represents the signal appearing at point 13. It can be noted that this signal changes in amplitude depending on whether the sensor is actuated or not. The level C4 represents the mean value of the signal appearing at the first input of comparator 14 due to the presence of filter 17. Ideal conditions are supposed in this graph in order to illustrate the operating principle. Level C5 represents the reference voltage level $U_R$ applied at the second input of comparator 14 of FIG. 2.

FIG. 3D represents the output signal of the comparator 14 appearing at point 15. This signal is low when the voltage at the first comparator input is higher than the reference voltage and becomes high when the voltage at the first comparator input is lower than the reference voltage.

It will be seen that the synchroneous detection at high frequency reduces the influence of disturbing fields of the mains frequency to a practically negligible amount compared to the useful signal and that even in an extremely strong field it becomes tolerable. The signal-to-noise ratio is in fact improved due to the above described synchroneous detection by a factor equal to the ratio of the frequencies of the high-frequency control signal to the low-frequency disturbing signal which is to be eliminated. For instance, if the mains frequency is of 50 Hz and the high frequency delivered by generator 12 is 20 kHz, the signal to noise ratio will be improved by a factor 400 by the synchroneous detection means.

Figure 4A:
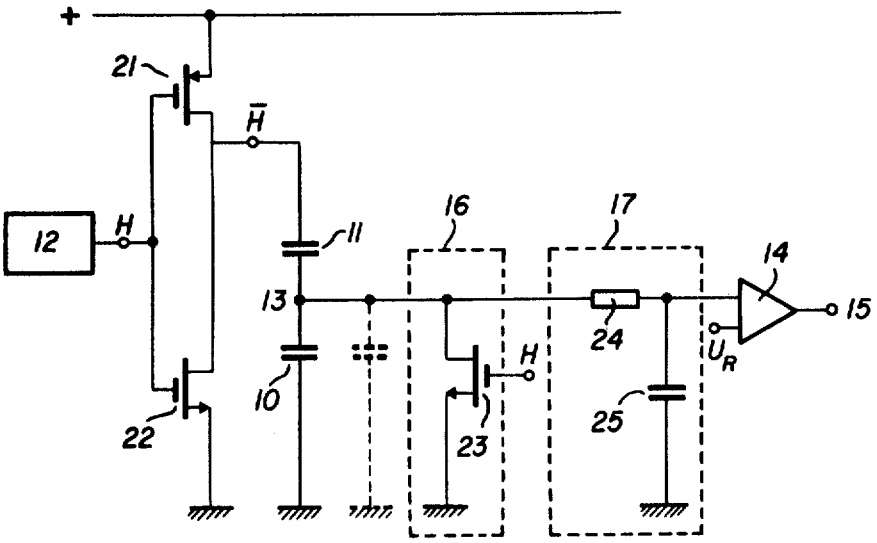
FIG. 4A is a more detailed diagram of the electric circuit of one embodiment of the device according to the invention.

FIG. 4A shows as an example an embodiment of the control device according to the invention for use in a quartz crystal watch. The device 12 delivers a clock signal H which can be derived directly from the quartz crystal oscillator of the watch or obtained therefrom through a frequency divider.

The clock signal H is applied to an inverter stage comprising two complementary insulated-gate field-effect transistors 21, 22 the conduction paths of which are connected in series between the positive power supply terminal and ground. The gates of these transistors are connected together and to the output of clock-signal source 12. At the common connection of the drains of transistors 21 and 22 appears a signal $\overline{H}$ which is inverted with respect to clock signal H. This signal is applied to the capacitive voltage divider 11, 10 as already described in connection with FIG. 2. The high-frequency controlled switching device 16 of FIG. 2 is constituted by an insulated-gate field-effect transistor 23 of N-type the drain of which is connected to the connection point 13 of capacitors 10 and 11, the source of which is connected to ground and the gate of which is controlled by the clock signal H. The low-pass filter 17 of FIG. 4A comprises a resistor 24 connected between point 13 and the first input of a comparator 14 and further comprises a capacitor 25 connected between the same first input of comparator 14 and ground. The low-pass filter 17 is adapted to suppress at least the clock frequency H. It reduces also any disturbing signal of a frequency higher than its cut-off frequency. It is to be noted that the reduction of the disturbance produced by an electric field of the mains frequency does not depend on the low-pass filter and is therefore obtained without increasing the operating time of the control device. If an increase of the operating time can be allowed, an additional filtering can be obtained by a non-critical low-pass filter. If R is the value of resistor 24 and C the capacitance of capacitor 25, 1/RC must in any case be less than the clock frequency H.

Figure 5:
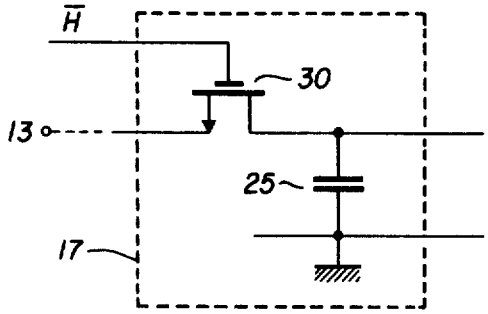
FIG. 5 is an electric diagram of a part of the circuit of FIG. 4 according to another embodiment.

The low-pass filter 17 in FIG. 4A can be replaced by any other device capable of delivering the mean value or the peak value of the voltage drop across the sensor. The circuit of FIG. 5 for instance delivers a signal corresponding to the peak value. This circuit comprises a field-effect transistor 30 the conduction path of which is connected between point 13 and the first input of comparator 14 and the gate of which is controlled by the pulses $\overline{H}$ as referred to in FIG. 4A. A capacitor 25 is connected in the same way as in FIG. 4A.

In the device according to the invention, as schematically shown in FIG. 2, the reference voltage $U_R$ must have a value resulting in a clear difference between the potentials at both inputs of comparator 14 in either state of the sensor. Comparator 14 can be, for instance, a differential amplifier. It is in particular necessary to provide a well-defined output state of the device when the sensor is not actuated. For practical purposes $U_R$ is preferably chosen as the means value of the voltages appearing at the first comparator input in the actuated and in the non-actuated states of the sensor.

The reference voltage can for instance be derived from the power supply voltage, in particular by means of a voltage divider.

Figure 4B:
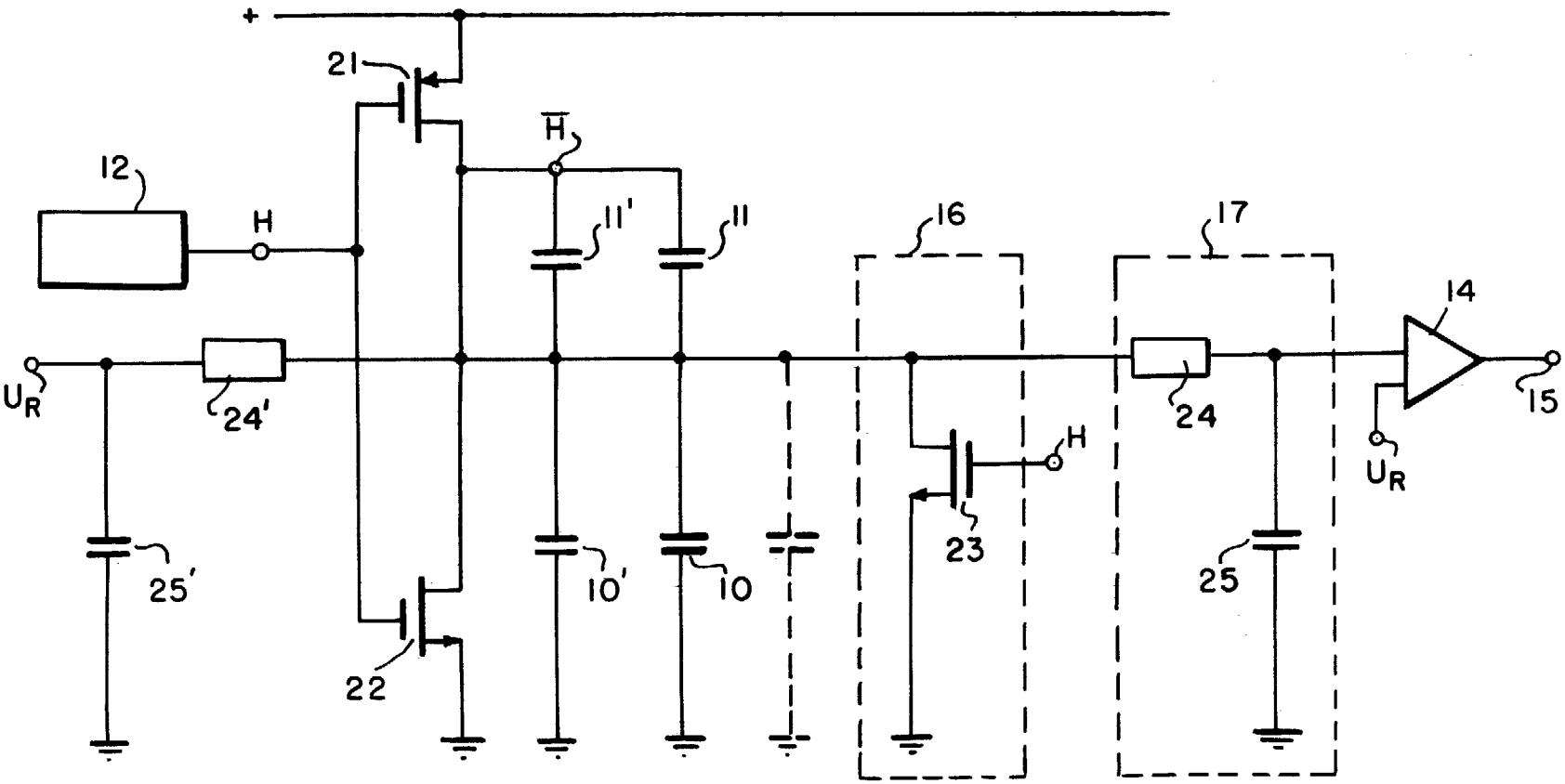
FIG. 4B is similar to FIG. 4A but includes a capacitive reference voltage divider.

However, it is preferable to produce the reference voltage from the high-frequency voltage applied to the sensor. In this case, the value $U_R$ will change proportionally to the signal voltage when a change in the power supply voltage occurs. This is an important feature for watches fed from dry cells. For instance a capacitive reference voltage divider similar to that of the sensor but of fixed ratio can be provided. This is shown in FIG. 4B which shows a circuit similar to that in FIG. 4A, but to which is added the capacitors 10', 11', 25', along with resistor 24' to form the fixed ratio reference voltage divider. The reference capacitor corresponding in this reference voltage divider to the sensor capacitor can be arranged under the watch-glass similarly to the sensor but at a place where it cannot be actuated by a finger, or it can be part for instance of an integrated circuit of the watch. Such a reference voltage divider allows to compensate also a drifting of the capacitance values of the various capacitors.

A more sophisticated solution consists in charging a capacitor up to a voltage derived from the sensor signal and following the same automatically. The voltage across this capacitor can then be taken as a reference voltage. If the capacitor and the circuit are of a high quality, it will then be possible to recharge the capacitor only at relatively long intervals and the reference voltage becomes independent of the drifts and absolute values of the capacitors and other circuit elements concerned.

Such a device for automatically regulating the reference voltage of comparator 14 will now be described in connection with the diagram of FIG. 6 and the graphs of FIG. 7.

Figure 9:
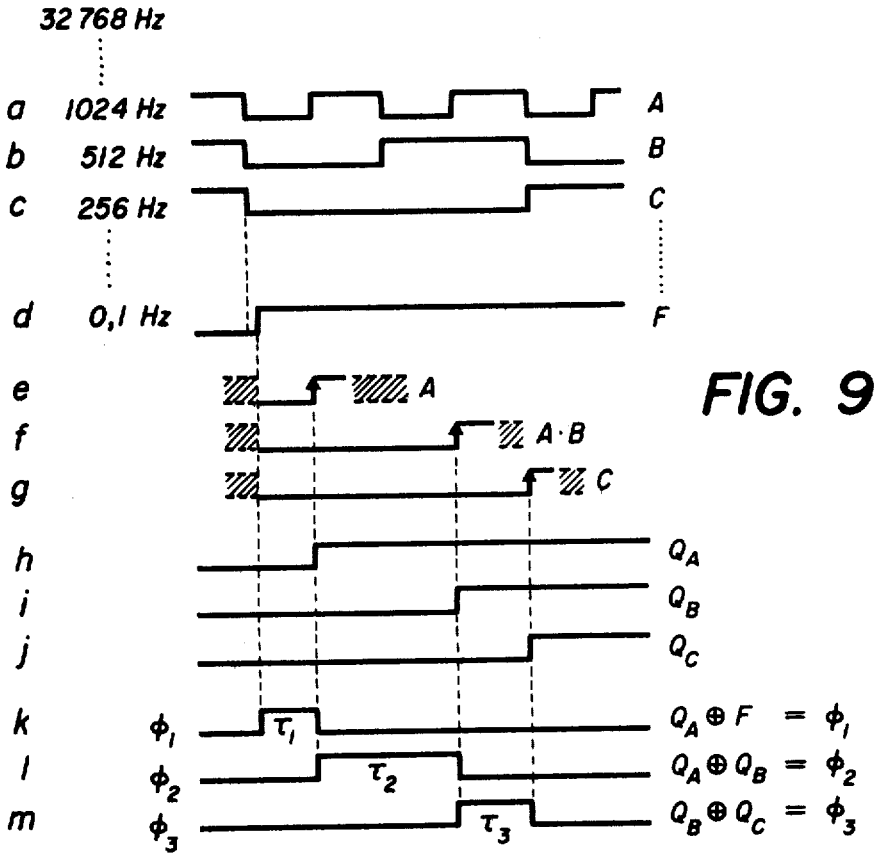
FIG. 9 is a time-chart of signals derived from the clock signals and appearing in the circuits of FIGS. 6 and 8.

The first input of comparator 14 is connected to a terminal 40 to which the output signal E of the detecting section 16, 17 of FIGS. 2 and 4A or 4B is applied. The circuit of FIG. 6 is controlled by three pilot signals $\phi_1$, $\phi_2$, $\phi_3$, formed of periodical pulses such as represented in FIG. 9, lines k, l and m. The circuit of FIG. 6 comprises capacitors 41 and 42, a resistor 43 and insulated-gate field-effect transistors 401 to 418 among which the transistors 401, 402, 405, 406, 408, 410, 413, 414, 416 and 417 are of the N-channel type and the others of the P-channel type. A power supply voltage is applied between terminals designated + and − corresponding respectively to a positive potential $U_A$ and ground.

Transistors 407 and 408 are connected in series between the terminals + and − and signal $\phi_3$ is applied to their respective gates. At the common connection point of the drains of the transistors therefore appears an inverted signal $\overline{\phi}_3$. Similarly, transistors 409 and 410 are connected in series between the terminals + and − and signal $\phi_1$ is applied to their respective gates. At the common connection point of the drains of transistors 409 and 410 therefore appears the inverted signal $\overline{\phi}_1$. Transistors 411, 412, 413 and 414 are connected in series in the same order between the terminals + and −. The signal $\phi_1$ is applied to the gate of transistor 411. The output terminal S' of comparator 14 is connected to the gates of transistors 412 and 413. Signal $\overline{\phi}_1$ is further applied to the gate of transistor 414. The common connection point of transistors 412 and 413 constitutes the output terminal S'' of the inverter circuit formed by transistors 411 to 414. Transistors 415 to 418 are part of an amplifier circuit with a feedback loop comprising resistor 43, said amplifier circuit being controlled by the inverter circuit 411 to 414. Transistors 415 and 416 are connected in series between the terminals + and − and their gates are connected to S''. Transistors 417 and 418 are also connected in series between the terminals + and − and their gates are connected together and to the common connection of the drains of transistors 415 and 416. Resistor 43 is connected between the input terminal S'' and the output terminal S of the amplifier circuit, S being the common connection point of the drains of transistors 417 and 418.

Figure 7:
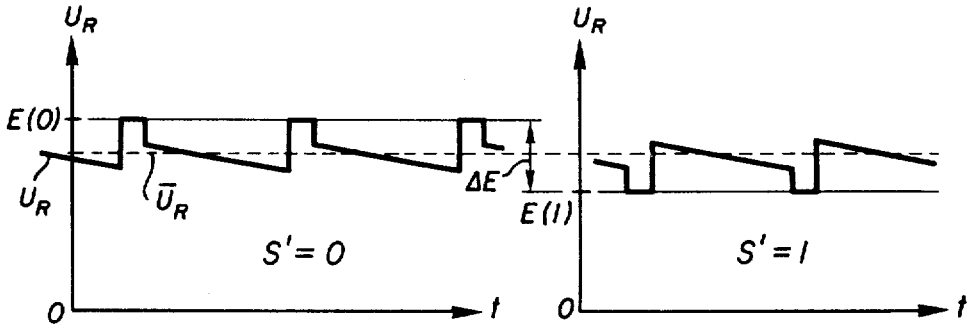
FIG. 7 is a time-chart of the voltage appearing in different cases of operation of the circuit of FIG. 6.

Referring to FIG. 7, at the time t=0 which marks the beginning of a sampling cycle, the state of the output terminal S' of comparator 14 is memorized as a binary state in synchronism with a pilot clock signal $\phi_1$. The information storage takes place by means of the amplifier circuit comprising transistors 415 to 418 controlled by the inverter circuit 411 to 414. During the period in which $\phi_1=1$ the inverter circuit provides at its output terminal S'' the inverted logic state with respect to input terminal S'. The state of the output terminal S'' is the same as that of the output terminal S during $\phi_1=0$.

The pilot signal $\phi_2$ is applied to the gates to two field-effect transistors 401 and 402, the drains of which are connected to the first input of comparator 14. The source of transistor 401 is connected to the second input of comparator 14, through a capacitor 41 to the terminal −, and through a capacitor 42 to the source of transistor 402. The pilot pulse $\phi_2$ thus controls the sampling of the voltage E provided by the capacitive sensor and the synchroneous detection device connected to terminal 40. The voltage E is applied to the capacitor 41 having a value $C_1$ through transistor 401, during the duration $\tau_2$ of the pulse $\phi_2$, so that the capacitor 41 is charged to the voltage E. The graphs of FIG. 7 represent in the left part the case in which the sensor is not actuated (S'=0), and on the right hand, the case in which the sensor is actuated (S'=1).

The duration $\tau_2$ of the pulse $\phi_2$ must be sufficient for allowing the voltage E to take again its nominal value after it has been disturbed by the charging of capacitor 41. It is therefore necessary that the period of the clock pulses H be substantially less then the time constant R ($C_1$+C), wherein R and C are the characteristic values of the low-passfilter as shown in FIG. 4 and $C_1$ is the capacitance of capacitor 41. Practically, it will be sufficient that $\tau_2=3R\ (C_1+C)$ to assure that capacitor 41 is charged to the nominal value of voltage E within this interval.

Due to the simultaneous triggering of the transistors 401 and 402 capacitor 42 is discharged during the charge of capacitor 41.

Figure 6:
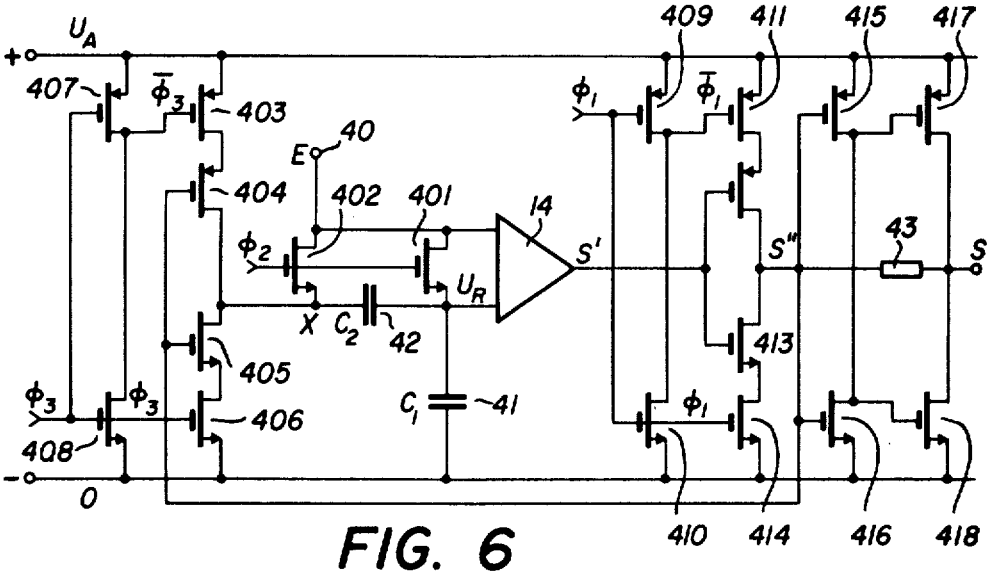
FIG. 6 is an electric diagram of a part of the circuit of FIG. 2 or 4, showing more particularly an embodiment of a circuit providing a reference voltage.

The circuit of FIG. 6 further comprises an inverter comprising 4 field effect transistors 403, 404, 405 and 406 connected in series between the +, − terminals. The inverted signal $\overline{\phi}_3$ is applied to the gate of transistor 403, while signal $\phi_3$ is applied to the gate of transistor 406. The gates of transistors 404 and 405 are connected together and to terminal S''. The common connection point of the drains of transistors 404 and 405 is connected to a point X, which is the connection point of capacitor 42 and the source of transistor 402. Therefore, the pilot pulse $\phi_3$ places the electrode of capacitor 42 which is connected to point X at the potential of the power supply terminal + or − in order to provide a difference between the voltage E and the reference voltage $U_R$ by adjusting the latter, so as to confirm the state of comparator 14.

It will be understood from the above that in the device of FIG. 6 the reference voltage is established in relation with the voltage across the sensor and that this reference level becomes thus independent of the aging of dry cells constituting the power supply and of the drifting of the relevant circuit elements.

FIG. 7 illustrates different stages of the above described adjusting process. If the sensor is not actuated by a finger, the reference voltage $U_R$ must be less than the voltage E (0) across the sensor. Capacitor 42 ($C_2$) must therefore be charged towards ground potential through transistors 405 and 406 which have become conducting by $\phi_3=1$ and $S''=1$. This will reduce the reference voltage $U_R$. If the sensor is actuated by the finger of the person bearing the watch, the reference voltage $U_R$ must be higher than the voltage E (1). Capacitor 42 must thus be charged towards the positive supply potential through transistors 403 and 404 which are made conducting by the states $\overline{\phi}_3=1$ and $S''=0$. This will increase the reference voltage $U_R$. If it is desired to maintain the value $U_R$ constant, the condition $C_2=C_1\cdot\Delta E/U_A$ must be satisfied, $\Delta E=E(0)-E(1)$ designating the variation of E between the actuated and the non-actuated state of the sensor and $U_A$ the power supply voltage.

In the device according to FIG. 2, ΔE is proportional to the supply voltage $U_A$ so that a correct operation of the automatic adjusting means for the reference voltage is obtained independently of the value of the power supply voltage $U_A$. Furthermore, the use of digital memory means at the output of the comparator eliminates a drift of the voltage at that output during the sampling period and provides for a continuous operation of the logic circuit controlled by the output S''.

The adjusting cycle of the reference voltage is repeated at a rate depending on the quality of the analogic memory comprising transistor 401 and capacitor 41. The leakage currents (drain-source current of transistor 401 when $\phi_2=0$ and source-substrate current of this transistor), reached at present are so low that the use of a capacitor 41 of 150 picofarads, allows to reduce the frequency of the adjustments to about 0.1 Hz.

Figure 8:
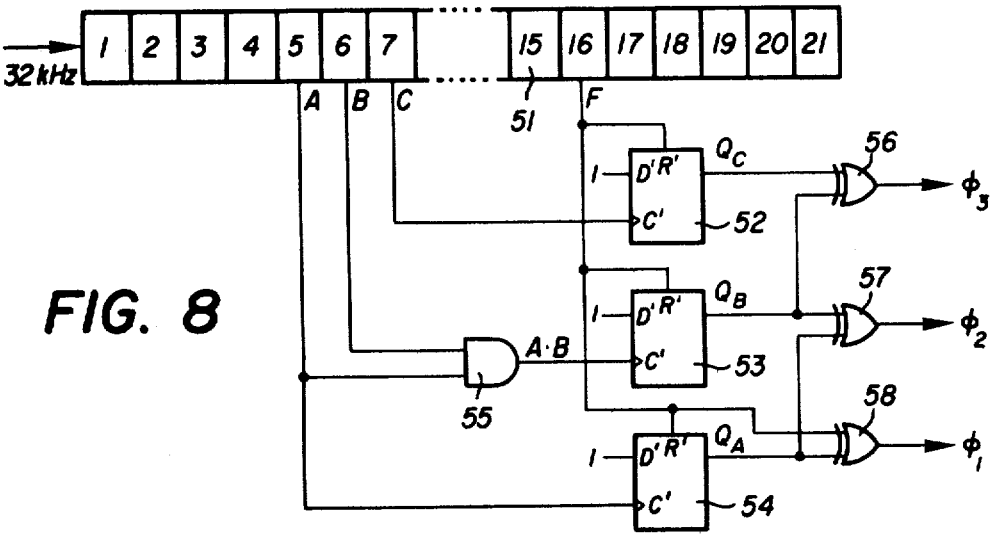
FIG. 8 is a block-diagram showing a circuit for providing clock signals as used in the circuit of FIG. 6.

FIG. 8 shows a circuit that can be used for providing the pilot signals $\phi_1$, $\phi_2$ and $\phi_3$ as referred to in connection with FIG. 6, and FIG. 9 shows the signals appearing at various points of the circuit of FIG. 8. This circuit comprises a divider chain 51 including binary frequency dividers $\mathbf{51}_1$ to $\mathbf{51}_{15}$ and decimal frequency dividers $\mathbf{51}_{16}$ to $\mathbf{51}_{21}$. The input signal of this chain is a high-frequency signal which can be derived from a quartz crystal oscillator of the watch and has in the present example the frequency of 32.768 Hz ($2^{15}$ Hz). With this input frequency, frequencies of respectively 1024, 512, and 256 Hz are obtained at the output terminals A, B and C of dividers $\mathbf{51}_5$, $\mathbf{51}_6$ and $\mathbf{51}_7$. Three D-flip-flop circuits 52, 53 and 54 are provided, having each a clock input C', a data input D' and a reset input R'. The respective output terminals of these flip-flops are designated $Q_C$, $Q_B$ and $Q_A$. The three reset inputs R' of flip-flops 52, 53 and 54 are connected to the output of divider $\mathbf{51}_{16}$ delivering a signal F of a frequency of 0.1 Hz. The inputs D' of these flip-flops are maintained at logic state 1. The outputs $Q_A$, $Q_B$ and $Q_C$ of the flip-flops are brought to logic state 1 by the first input pulse which is applied to the respective inputs C' after a reset input R' has become high (logic 1) by means of signal F. Flip-flop 54 receives at its clock input the signal A. Flip-flop 53 receives at its clock input a signal A.B provided by an AND-gate 55. Flip-flop 52 receives at its clock input the signal C.

The time-chart of FIG. 9 shows in line a the signal A, in line b the signal B, in line c the signal C, in line d the signal F, in line e the active transient of signal A controlling flip-flop 54, in line f the active transient of signal A.B controlling flip-flop 53, in line g the active transient of signal C controlling flip-flop 52, and in lines h, i and j the respective output signals at $Q_A$, $Q_B$ and $Q_C$ of flip-flops 54, 53 and 52.

The circuit of FIG. 8 further comprises exclusive-OR-gates 56, 57 and 58. Gate 57 receives the output signals $Q_B$ and $Q_C$ of flip-flops 53 and 52 and delivers the signal $\phi_3=Q_B\oplus Q_C$. The gate 57 receives the output signals $Q_A$ and $Q_B$ of flip-flops 54 and 53 and delivers the signal $\phi_2=Q_A\oplus Q_B$. Gate 58 receives the output signal $Q_A$ of flip-flop 54 and the reset signal F and delivers the signal $\phi_1=Q_A\oplus F$. Thus signals $\phi_1$, $\phi_2$ and $\phi_3$ are obtained as shown in FIG. 9 which are appropriate pilot signals for controlling the circuit of FIG. 6.

It results from the above description that the control device according to the invention allows the use of control means comprising capacitive sensors to be actuated by placing a finger on the watch-glass. A synchroneous detector rejects low-frequency disturbing signals without delaying the operation of the device. Furthermore the synchroneous detection according to the invention allows the use of a non-critical low-pass filter for additional filtering at the cost of an increase of the response time of the device. The output signal can be obtained by means of a differential amplifier comparing the signal issued by the capacitive sensor to a reference signal. If the reference signal is obtained by means of reference capacitors, the absolute value of the various capacitors is not critical and the aging of the circuit elements is compensated. If the reference signal is obtained by storing the sensor signal in the non-actuated state, the device is totally independent on the value of the relevant circuit elements.

We claim:

1. An electronic watch control device for manual actuation comprising a capacitive sensor which includes a conductive layer applied on at least a part of the inner surface of the watch-glass and the capacitance of which with respect to ground as represented by the watch-case varies when the user puts a finger on the watch-glass, the said sensor being part of a capacitive voltage divider, the control device further comprising means for applying to the said capacitive voltage divider an a.c. voltage of a substantially higher frequency than the mains frequency, synchroneous detection means for detecting the high-frequency voltage across the said capacitive sensor, wherein the synchroneous detection means include a switching device connected to the terminals of the capacitive sensor and controlled by the said high frequency so as to alternately shot-circuit the sensor and apply the voltage appearing at the terminals of the sensor to a low-pass filter, and comparison means for comparing the value of the said high frequency voltage to a reference voltage, said comparison means being adapted for producing a control signal depending on whether or not the sensor is actuated by placing a finger-tip on the watch-glass.

2. An electronic watch control device for manual actuation comprising a capacitive sensor which includes a conductive layer applied on at least a part of the inner surface of the watch-glass and the capacitance of which with respect to ground as represented by the watch-case varies when the user puts a finger on the watch-glass, the said sensor being part of a capacitive voltage divider, the control device further comprising means for applying to the said capacitive voltage divider an a.c. voltage of a substantially higher frequency than the mains frequency, synchroneous detection means for detecting the high-frequency voltage across the said capacitive sensor, a capacitive reference voltage divider including a capacitor constructed similarly to the sensor capacitor but being arranged such that the reference voltage divider presents a fixed capacitance ratio, and means for applying the said a.c. voltage to the reference voltage divider, and comparison means for comparing the value of the said high frequency voltage to a reference voltage, said comparison means being adapted for producing a control signal depending on whether or not the sensor is actuated by placing a finger-tip on the watch-glass.

3. An electronic watch control device for manual actuation comprising a capacitive sensor which includes a conductive layer applied on at least a part of the inner surface of the watch-glass and the capacitance of which with respect to ground as represented by the watch-case varies when the user puts a finger on the watch-glass, the said sensor being part of a capacitive voltage divider, the control device further comprising means including the clock signal generator of the watch for applying to the said capacitive voltage divider an a.c. voltage of a substantially higher frequency than the mains frequency, synchronous detection means for detecting the high-frequency voltage drop across the said capacitive sensor, said synchronous detection means including a switching device connected to the terminals of the capacitive sensor and controlled by the said high frequency so as to alternately short-circuit the sensor and apply the voltage appearing at the terminals of the sensor to a low-pass filter, said switching device being an insulated-gate field-effect transistor the conduction path of which is connected in parallel with the sensor, and comparison means for comparing the value of said high frequency voltage to a reference voltage, said comparison means being adapted for producing a control signal depending on whether or not the sensor is actuated by placing a finger-tip on the watch-glass.

4. A control device as claimed in claim 3 for watches controlled by a quartz crystal including a generator of clock pulses, comprising means for producing a reference voltage, said means including a memory device for storing the voltage accross the sensor during the non-actuated state thereof and means for periodically readjusting the level of the reference voltage under the control of the said clock pulses.

5. An electronic watch control device for manual actuation comprising a capacitive sensor which includes a conductive layer applied on at least a part of the inner surface of the watch-glass and the capacitance of which with respect to ground as represented by the watch-case varies when the user puts a finger on the watch-glass, the said sensor being part of a capacitive voltage divider, the control device further comprising means for applying to the said capacitive voltage divider an a.c. voltage of a substantially higher frequency than the mains frequency, synchroneous detection means for detecting the high-frequency voltage across the said capacitive sensor, and comparison means for comparing the value of the said high frequency, voltage to a reference voltage, said comparison means being adapted for producing a control signal depending on whether or not the sensor is actuated by placing a finger-tip on the watch-glass, the control device controlled by a quartz crystal including a generator of clock pulses, comprising means for producing a reference voltage, said means including a memory device for storing the voltage across the sensor during the non-actuated state thereof and means for periodically readjusting the level of the reference voltage under the control of the said clock pulses.

* * * * *